US007986899B2

(12) United States Patent
Kuramoto et al.

(10) Patent No.: US 7,986,899 B2
(45) Date of Patent: Jul. 26, 2011

(54) DEVELOPMENT UNIT, PROCESS CARTRIDGE AND IMAGE FORMING APPARATUS

(75) Inventors: Shinichi Kuramoto, Kanagawa (JP); Yoshifumi Ozaki, Kanagawa (JP); Takashi Ochi, Kanagawa (JP); Shinichiro Fujimori, Kanagawa (JP); Kenji Ogi, Kanagawa (JP); Akihiko Noda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 14 days.

(21) Appl. No.: 12/417,264

(22) Filed: Apr. 2, 2009

(65) Prior Publication Data

US 2010/0061768 A1 Mar. 11, 2010

(30) Foreign Application Priority Data

Sep. 5, 2008 (JP) ..... P2008-228840

(51) Int. Cl.
*G03G 15/08* (2006.01)
*G03G 15/09* (2006.01)

(52) U.S. Cl. ..... 399/104; 399/254

(58) Field of Classification Search ..... 399/104, 399/103, 254, 256

See application file for complete search history.

(56) References Cited

U.S. PATENT DOCUMENTS

| | | | | | |
|---|---|---|---|---|---|
| 5,267,007 | A | * | 11/1993 | Watanabe et al. | 399/104 |
| 5,287,148 | A | * | 2/1994 | Sakemi et al. | 399/104 |
| 5,450,169 | A | * | 9/1995 | Hart et al. | 399/104 |
| 5,742,876 | A | * | 4/1998 | Bogoshian | 399/104 |
| 2004/0081480 | A1 | * | 4/2004 | Matsumaru et al. | 399/103 |

FOREIGN PATENT DOCUMENTS

| | | | | |
|---|---|---|---|---|
| JP | 56-120819 | A | * | 9/1981 |
| JP | 63-124075 | A | * | 5/1988 |
| JP | 2-64961 | U | | 5/1990 |
| JP | 05-134540 | | | 5/1993 |
| JP | 11-109734 | | | 4/1999 |
| JP | 2005-055609 | | | 3/2005 |

OTHER PUBLICATIONS

Machine translation of JP 05-134540 A datedJul. 5, 2010.*

* cited by examiner

*Primary Examiner* — Sophia S Chen

(74) *Attorney, Agent, or Firm* — Morgan, Lewis & Bockius LLP

(57) ABSTRACT

A development unit includes a developer accommodating part that accommodates a developer therein, a developer stirring-transporting member that transports the developer in the developer accommodating part while stirring the developer, a bearing part that receives a rotating shaft of the developer stirring-transporting member, a magnetic member that is located between the bearing part and the developer accommodating part and fixed around the rotating shaft, and a stirring member that is spaced apart from the magnetic member so as to be opposed to the magnetic member and that is arranged at the rotating shaft of the developer stirring-transporting member.

10 Claims, 6 Drawing Sheets

DEVELOPMENT UNIT, PROCESS CARTRIDGE AND IMAGE FORMING APPARATUS

CROSS-REFERENCE TO RELATED APPLICATION

This application is based on and claims priority under 35 USC 119 from Japanese Patent Application No. 2008-228840 filed Sep. 5, 2009.

BACKGROUND

1. Technical Field

The present invention relates to a development unit, a process cartridge and an image forming apparatus.

2. Related Art

In an image forming apparatus adopting an electrophotographic system, such as a copying machine or a printer, a toner image is formed on a charged body (for example, a photoreceptor), its toner image is transferred to a transferred body (for example, paper), and the toner image carried on the transferred body is fixed by a fixing unit. Herein, in order to form a toner image on the charged body, a development unit accommodating developer therein is arranged correspondingly to a development area of the charged body, and toner is made to fly from the development unit or the developer is rubbed, thereby to attach toner onto an electrostatic latent image formed on the charged body. On the other hand, as the developer, there are a single component developer composed of only magnetic toner or non-magnetic toner, and a two-component developer composed of toner and carrier.

In a development unit using the two-component developer, a developer stirring-transporting member is provided in a housing of the development unit. The developer stirring-transporting member of this stirring unit mixes the two-component developer in the housing and the new-supplied toner together, and makes the carrier and the toner of the two-component developer charged.

On the other hand, in the housing of the development unit, a magnetic member is disposed around a bearing portion, and the carrier in the developer is attracted to the magnetic member, thereby to form a so-called magnetic seal.

SUMMARY

An object of the invention is to provide a development unit which suppresses occurrence of toner cohesion accompanied by heat generation of a sliding portion in the development unit.

The above problem may be achieved by the following invention. Namely, the development unit of the invention has the following features.

According to an aspect of the invention, a development unit includes a developer accommodating part that accommodates a developer therein, a developer stirring-transporting member that transports the developer in the developer accommodating part while stirring the developer, a bearing part that receives a rotating shaft of the developer stirring-transporting member, a magnetic member that is located between the bearing part and the developer accommodating part and fixed around the rotating shaft, and a stirring member that is spaced apart from the magnetic member so as to be opposed to the magnetic member and that is arranged at the rotating shaft of the developer stirring-transporting member.

According to the aspect of the invention, it is suppressed that the developer attracted to the magnetic member stays on the rotating shaft and the toner coheres.

BRIEF DESCRIPTION OF THE DRAWINGS

Exemplary embodiments of the invention will be described in detail based on the following figures, wherein.

DETAILED DESCRIPTION

Embodiments of the invention will be described below. In order to explain the exemplary embodiments of the invention in detail, firstly an outline of a development unit in the exemplary embodiment will be explained, and thereafter the stirring constitution of a magnetic seal portion in a developer stirring-transporting member of the development unit will be described in detail. The developer stirring-transporting member in each exemplary embodiment means including a paddle member and a stirring roll described later. Taking a stirring roll as an example of the developer stirring-transporting member, and taking two-component developer composed of toner and carrier as an example of developer, the exemplary embodiments will be described below.

Figure 1:
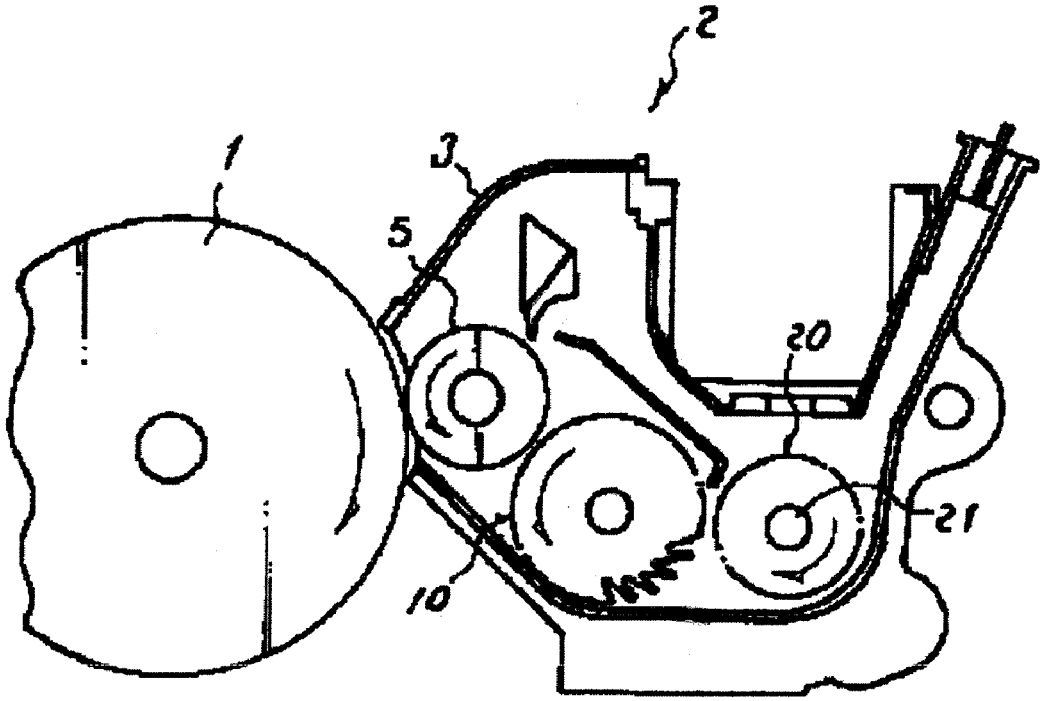
FIG. 1 is a sectional view showing a constitutional example of a development unit in an exemplary embodiment of the invention.

As shown in FIG. 1, a development unit 2 in the exemplary embodiments is constituted so that a development roll 5 is exposed through an opening provided in a housing 3. The development roll 5 is arranged oppositely to a photoreceptor 1 that is a charged body, and a comparatively narrow gap is formed between the development roll 5 and the photoreceptor 1. The photoreceptor 1 is rubbed with a toner brush formed on a surface of the development roll 5, and toner is moved onto an electrophotographic latent image formed on the photoreceptor 1, whereby the electrophotographic latent image is made visible as a toner image. Further, in the development unit 2, a paddle member 10 is disposed in a position close to the development roll 5, and a stirring roll 20 is disposed in a position where the developer is supplied. On a surface of the paddle member 10, many projecting strips are arranged in a projecting state toward a feed direction, and feed out the developer toward the development roll 5. Further, to a rotating shaft 21 of the stirring roll 20, many disc-shaped members 23 (shown in FIGS. 2, 4, 6 and 8) made of metal (for example, aluminum) are attached in a skewering manner in an inclined state at a predetermined angle to the rotating shaft 21. By rotating the stirring roll, the developer is stirred with the disc-shaped members.

First Exemplary Embodiment

Figure 2:
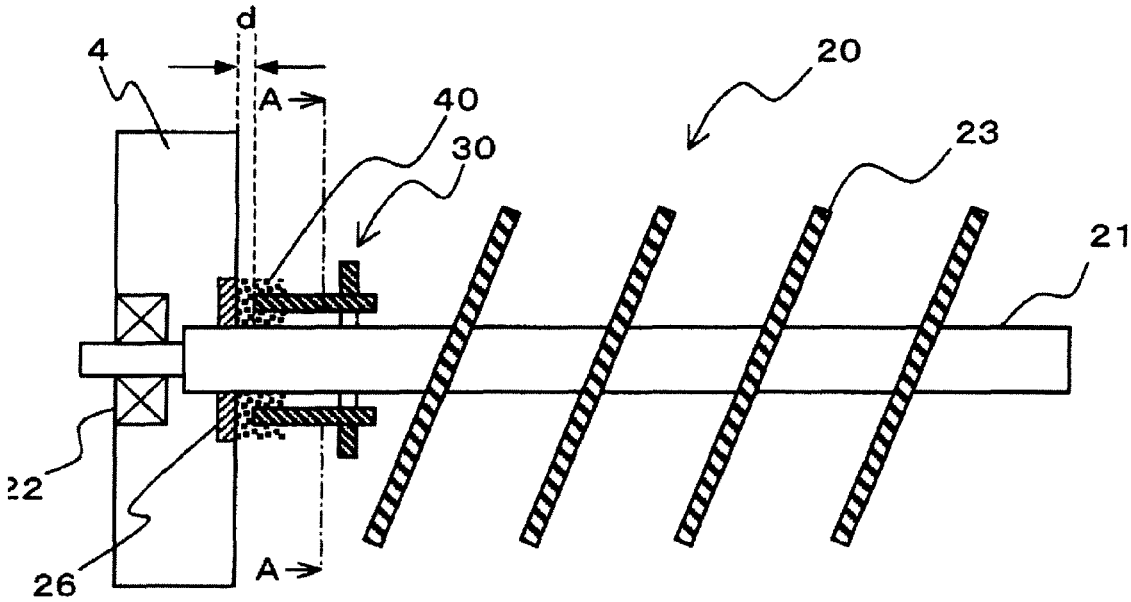
FIG. 2 is a transverse sectional view showing a constitutional example of a rotating roll in a first exemplary embodiment of the invention.

A stirring roll in a first exemplary embodiment will be described with reference to FIGS. 2 and 3. In order to support a rotating shaft 21 of a stirring roll 20, a bearing 22 is provided at a bearing portion of a frame 4 of a housing. Further, oppositely to the bearing 22, a magnetic member 26 is disposed around the bearing portion in the frame 4. The magnetic member 26 uses an arbitrary magnetic member, and is disposed by embedding a disc-shaped magnetic in the frame 4. Further, on the bearing portion side of the rotating shaft 21, a stirring member 30 is provided oppositely to the magnetic member 26.

Figure 3:
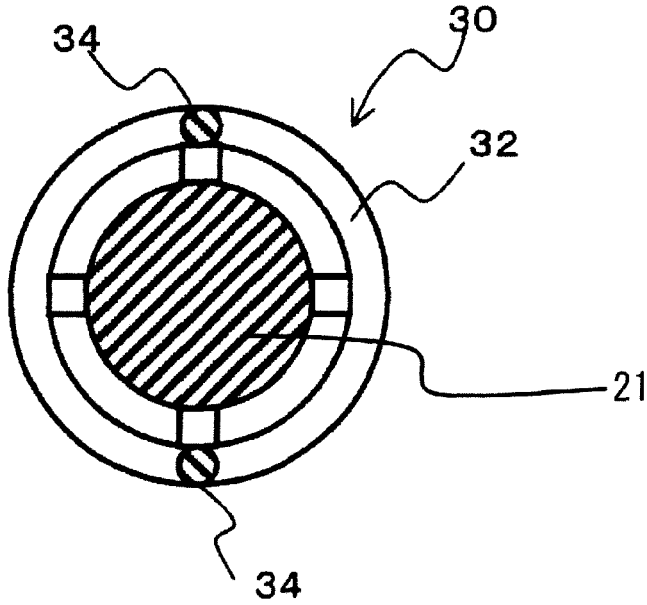
FIG. 3 is a sectional view taken along a line A-A in FIG. 2, explaining the structure of a stirring member in the first exemplary embodiment.

Further, in the stirring member 30 of the stirring roll in the exemplary embodiment, as shown in FIG. 3, a disc-shaped member 32 is disposed at the rotating shaft 21 on the bearing portion side, and one and more rod-shaped member 34 are provided at the disc-shaped member 32 so as to protrude toward the magnetic member 26. Hereby, a developer 40 accumulating on the rotating shaft 21 moves continuously or sequentially, whereby it is suppressed that the developer 40 stays and accumulates on the rotating shaft 21. Further, the leading end of the rod-shaped member 34 and the magnetic member 26 are spaced d-dimension apart so that the developer attracted to the magnetic member 26 can be held between them.

In the exemplary embodiment, the developer attracted to the magnetic member 26 moves continuously or sequentially by the stirring member 30 provided at the rotating shaft 21. Hereby, it is suppressed that the developer attracted to the magnetic member 26 stays on the rotating shaft for a long time and the toner coheres. For example, even in case that heat is generated by the rotation in a sliding portion between the rotating shaft 21 of the development unit and the bearing portion, it is suppressed that the developer coheres on the rotating shaft 21. By suppressing the cohesion of the developer on the rotating shaft 21, for example, wear of the bearing of the bearing portion is suppressed and an increase in drive torque of the rotating shaft 21 is prevented.

The stirring member 30 is formed of metallic material or resin material. From viewpoints of low thermal conductivity from the rotating shaft 21 and easiness in processing, the resin material may be the metallic material. As the resin material, from a viewpoint of strength, for example, ABS resin (acrylonitrile-butadiene-styrene resin), or resin in which glass fiber is filled is used. Further, in order to give opposite magnetic property to the magnetic property of the magnetic member 26 to the stirring member 30, for example, a magnetic material is dispersed and filled in the resin material forming the stirring member 30. Here, as the magnetic material, for example, iron oxide, chromium oxide, cobalt, or ferrite is used.

Second Exemplary Embodiment

Figure 4:
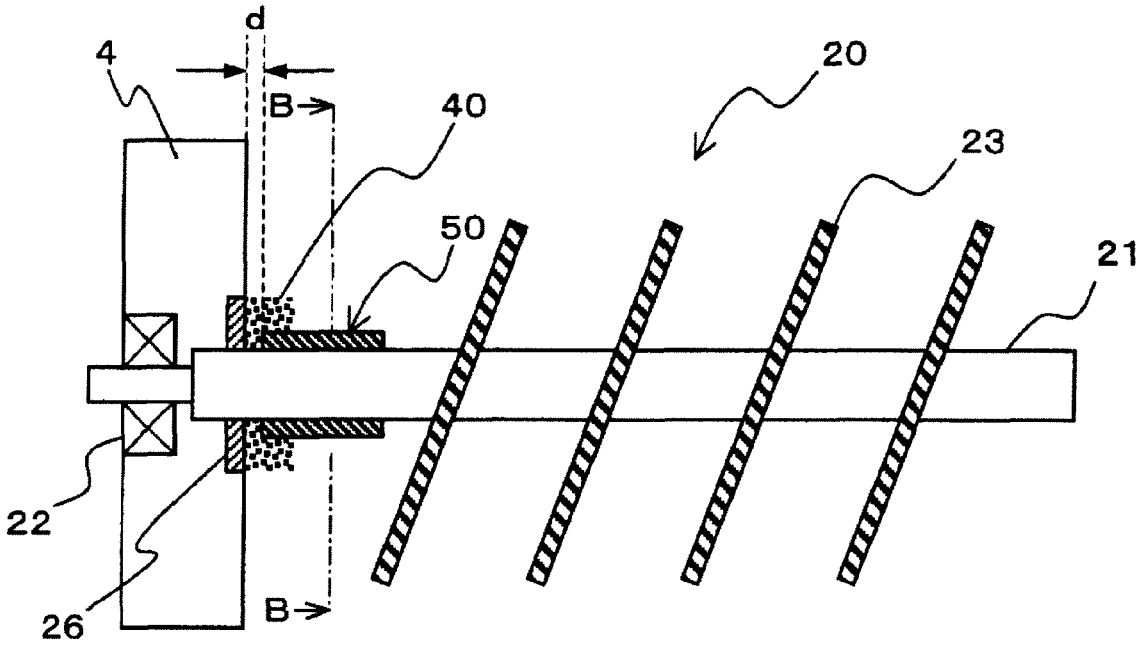
FIG. 4 is a transverse sectional view showing a constitutional example of a rotating roll in a second exemplary embodiment of the invention.
Figure 5:
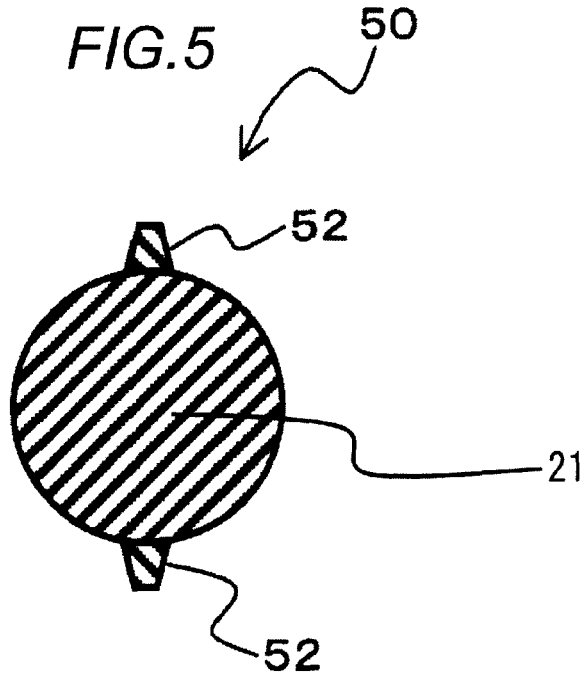
FIG. 5 is a sectional view taken along a line B-B in FIG. 4, explaining the structure of a stirring member in the second exemplary embodiment.

A stirring roll in a second exemplary embodiment will be described with reference to FIGS. 4 and 5. The same components as those in the first exemplary embodiment are denoted by the same symbols, and their description will be omitted.

In the exemplary embodiment, on the bearing portion side of a rotating shaft 21, a stirring member 50 is provided on the rotating shaft 21. Hereby, a developer 40 accumulating on the rotating shaft 21 moves continuously or sequentially, whereby it is suppressed that the developer 40 stays and coheres on the rotating shaft 21. The stirring member 50 in the exemplary embodiment, as shown in FIG. 5, is composed by one and more plate-shaped members 52, and, in consideration of preventing developer accumulation, the plate-shaped member 52 may be formed in the shape of a blade which becomes thinner toward its leading end. Further, the plate-shaped member 52 and a magnetic member 26 are spaced d-dimension apart so that the developer attracted to the magnetic member 26 can be held between them. Further, since the material of the stirring member 50 is the same as the material of the above-mentioned stirring member 30, its description will be omitted here.

Third Exemplary Embodiment

Figure 6:
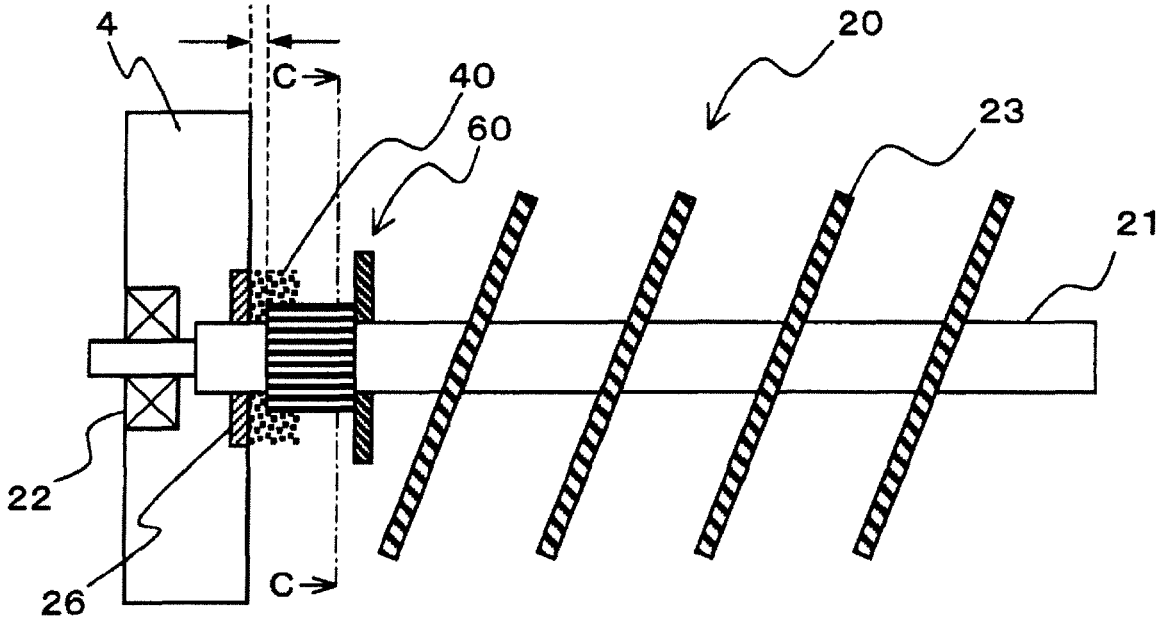
FIG. 6 is a transverse sectional view showing a constitutional example of a rotating roll in a third exemplary embodiment of the invention.
Figure 7:
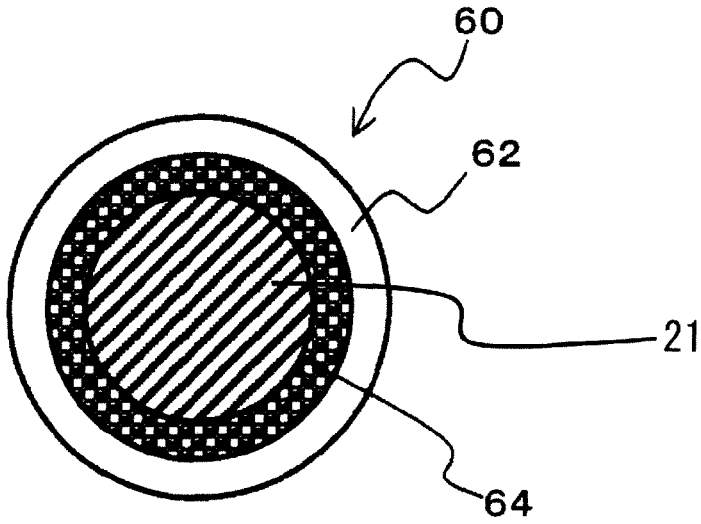
FIG. 7 is a sectional view taken along a line C-C in FIG. 6, explaining the structure of a stirring member in the third exemplary embodiment.

A stirring roll in a third exemplary embodiment will be described with reference to FIGS. 6 and 7. The same components as those in the first and second exemplary embodiments are denoted by the same symbols, and their description will be omitted.

In the exemplary embodiment, on the bearing portion side of a rotating shaft 21, a stirring member 60 is provided on the rotating shaft 21. Hereby, a developer 40 accumulating on the rotating shaft 21 moves continuously, whereby it is suppressed that the developer 40 stays and coheres on the rotating shaft 21. The stirring member 60 in the exemplary embodiment is a brush-shaped member, in which a disc-shaped member 62 is disposed at the rotating shaft 21 on the bearing portion side as shown in FIG. 7, and a brush member 64 is disposed at the disc-shaped member 62 so as to be opposed to a magnetic member 26. Further, the brush-shaped member 64 and the magnetic member 26 are spaced d-dimension apart so that the developer attracted to the magnetic member 26 can be held between them. Further, since the material of the brush member 64 in the exemplary embodiment is the same as the material of the above-mentioned stirring member 30, its description will be omitted here. As the brush member 64 in the exemplary embodiment, such a brush is used that a tip force per brush constituting the brush member 64 is 0.0012 g in case that a brush diameter is $\phi$12 mm and the intrusion amount of the brush is 0.5 mm, or that a tip force is 0.0006 g in case that a brush diameter is $\phi$10 mm and the intrusion amount is 0.5 mm. As a material of the brush member, for example, ABS resin (acrylonitrile-butadiene-styrene resin), or resin in which glass fiber is filled is used.

Further, the brush member 64 may use a material in which a magnetic material such as iron oxide, chromium oxide, cobalt, or ferrite is dispersed in ABS resin (acrylonitrile-butadiene-styrene resin), or in resin in which glass fiber is filled.

Fourth Exemplary Embodiment

A stirring roll in a fourth exemplary embodiment will be described with reference to FIGS. 8 and 9. The same components as those in the first, second, third exemplary embodiments are denoted by the same symbols, and their description will be omitted.

In the exemplary embodiment, on the bearing portion side of a rotating shaft 21, a stirring member 70 is provided on the rotating shaft 21. Hereby, a developer 40 accumulating on the rotating shaft 21 moves continuously, whereby it is suppressed that the developer 40 stays and accumulates on the rotating shaft 21. The stirring member 70 in the exemplary embodiment is a brush-shaped member, which is larger in elastic modulus of a brush member and softer than the brush member used in the third exemplary embodiment. The stirring member 70 in the exemplary embodiment, since it is the brush member, is smaller in mechanical stress onto the developer than the stirring members having the other shapes. In result, even in case that a low-melting toner is used in the two-component developer, stress onto the low-melting toner is reduced.

Figure 8:
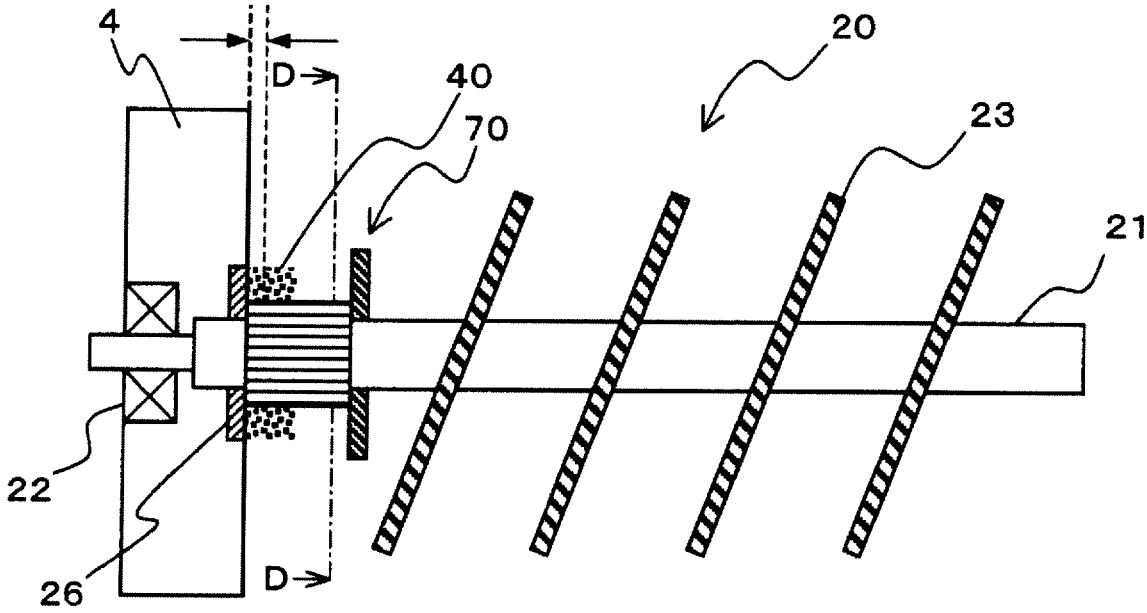
FIG. 8 is a transverse sectional view showing a constitutional example of a rotating roll in a fourth exemplary embodiment of the invention.
Figure 9:
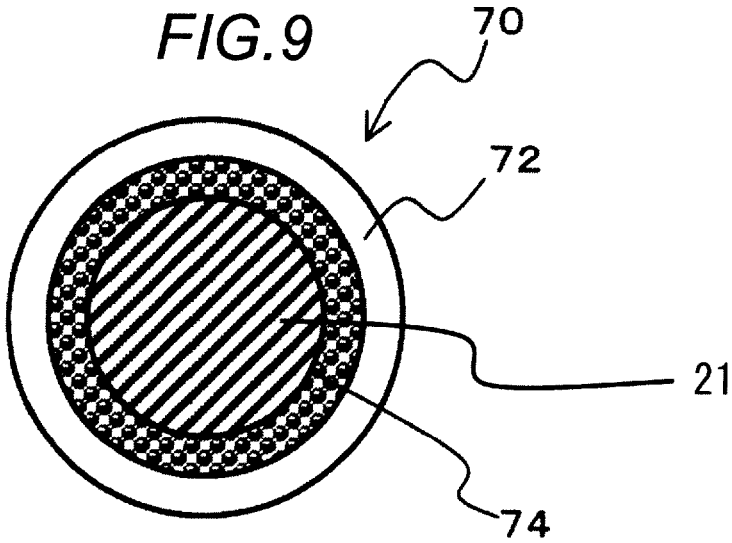
FIG. 9 is a sectional view taken along a line D-D in FIG. 8, explaining the structure of a stirring member in the fourth exemplary embodiment.

As shown in FIGS. 8 and 9, a disc-shaped member 72 is disposed at the rotating shaft 21 on the bearing portion side, and a brush member 74 is disposed at the disc-shaped member 72 so as to be opposed to a magnetic member 26. Further, the brush member 74 is arranged so as to come close to or come into contact with the magnetic member 26, because the brush member 74 is softer than the brush member used in the third exemplary embodiment and the mechanical stress onto the developer is resultantly smaller. Since a material of the brush member 74 in the exemplary embodiment is the same material as the material of the above-mentioned stirring member 30, its description is omitted here. As the brush member 74 in the exemplary embodiment, such a brush is used that a tip force per brush constituting the brush member 74 is 0.0006 g in case that a brush diameter is ϕ12 mm and the intrusion amount of the brush is 0.5 mm, or that a tip force is 0.00011 g in case that a brush diameter is ϕ10 mm and the intrusion amount is 0.5 mm. As a material of the brush member, for example, ABS resin (acrylonitrile-butadiene-styrene resin), or resin in which glass fiber is filled is used.

Further, the brush member 74 may use a material in which a magnetic material such as iron oxide, chromium oxide, cobalt, or ferrite is dispersed in the ABS resin (acrylonitrile-butadiene-styrene resin), or in the resin in which glass fiber is filled.

Figure 10:
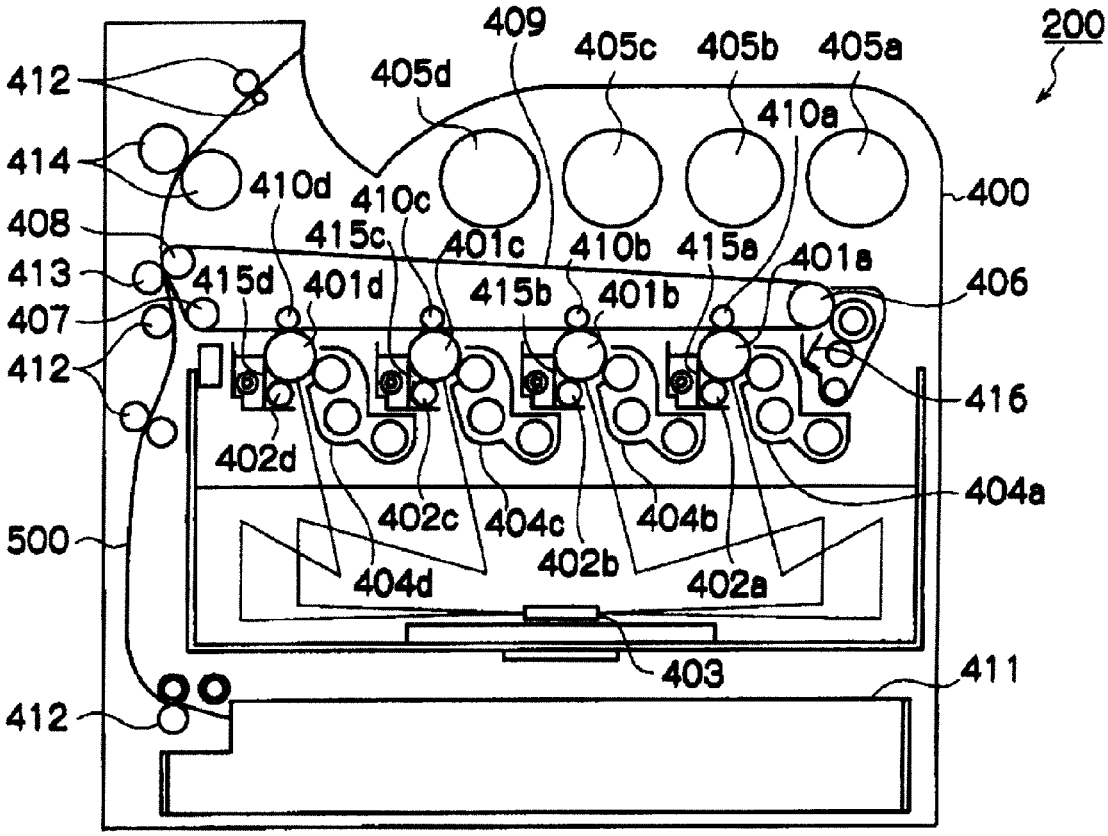
FIG. 10 is a schematic diagram showing a constitutional example of an image forming apparatus of the invention used in an image forming method.

FIG. 10 is an entire constitutional view showing an example of an image forming unit in the exemplary embodiment.

Next, an example of the image forming apparatus in the exemplary embodiment will be described.

FIG. 10 is a schematic diagram showing a constitutional example of an image forming apparatus for forming an image by an image forming method in the exemplary embodiment. In the shown image forming apparatus 200, four electrophotographic photoreceptors 401*a* to 401*d* are arranged in a housing 400 along an intermediate transfer belt 409 in parallel with one another. In the electrophotographic photoreceptors 401*a* to 401*d*, for example, the electrophotographic photoreceptor 401*a* can form an image of yellow, the electrophotographic photoreceptor 401*b* can form an image of magenta, the electrophotographic photoreceptor 401*c* can form an image of cyan, and the electrophotographic photoreceptor 401*d* can form an image of black.

The electrophotographic photoreceptor 401*a* to 401*d* can rotate in the predetermined direction (counterclockwise direction on the paper surface), and charge rolls 402*a* to 402*d*, development units 404*a* to 404*d*, first transfer rolls 410*a* to 410*d*, and cleaning blades 415*a* to 415*d* are arranged along its rotating direction. Toners of four colors of black, yellow, magenta, and cyan accommodated in toner cartridges 405*a* to 405*d* can be supplied to the development units 404*a* to 404*d*, respectively. Further, the first transfer rolls 410*a* to 410*d* come into contact with the electrophotographic photoreceptors 401*a* to 401*d*, respectively, through the intermediate transfer belt 409.

Further, in a predetermined position in the housing 400, an exposure unit 403 is arranged, which can irradiate optical beams emitted from the exposure unit 403 onto surfaces of the charged electrophotographic photoreceptors 401*a* to 401*d*. Hereby, in a rotation process of each electrophotographic photoreceptor 401*a* to 401*d*, charging, exposing, developing, first-transferring, and cleaning steps are performed in order, and toner images of the respective colors are multilayer-transferred on the intermediate transfer belt 409.

Here, the charge rolls 402*a* to 402*d* bring conductive members (charge rolls) into contact with the surfaces of the electrophotographic photoreceptors 401*a* 401*d* to apply voltage uniformly to the photoreceptors, and charge the photoreceptor surfaces at a predetermined potential (charging step). Further, using a charge brush, a charge film, or a charge tube in addition to the charge roll shown in the exemplary embodiment, contact electrification type charging may be performed. Further, using a corotron or a scorotron, non-contact electrification type charging may be performed.

As the exposure unit 403, can be used an optical system capable of causing the light from a light source such as a semiconductor laser, LED (light emitting diode), a liquid-crystal shutter, or the like to strike desirable image-wise on the surfaces of the electrophotographic photoreceptor 401*a* to 401*d*. In particular, when an exposure unit capable of exposing the photoreceptor surface to an incoherent light is used, interference fringes can be prevented from occurring between conductive substrates and photosensitive layers in the electrophotographic photoreceptors 401*a* to 401*d*.

As the development units 404*a* to 404*d*, can be used a general development unit which performs development by bringing the above-mentioned two-component developer for electrostatic charge image into contact or non-contact with the photoreceptor (development step). Such the development device is not particularly limited as long as the two-component developer for electrostatic charge image is used, and a known development unit can be selected appropriately according to a purpose. In a first transfer step, a first transfer bias having the opposite polarity to the polarity of the toner carried by image carriers is applied to the first transfer rolls 410*a* to 410*d*, whereby the toners of the respective colors are first-transferred in order from the image carriers to the intermediate transfer belt 409.

Cleaning blades 415*a* to 415*d* are used in order to remove the residual toner adhered to the surface of each electrophotographic photoreceptor after the transfer step. The electrophotographic photoreceptor is thus cleaned and is then repeatedly subjected to the above image forming process. As examples of the material of the cleaning blade, there are urethane rubbers, neoprene rubbers, and silicone rubbers.

The intermediate transfer belt 409 is supported with a predetermined tension by a drive roll 406, a back-up roll 408 and a tension roll 407, and can rotate by rotation of these rolls without causing flexure. Further, a second transfer roll 413 is disposed so as to come into contact with the back-up roll 408 through the intermediate transfer belt 409.

To the second transfer roll 413, a second transfer bias having the opposite polarity to the polarity of the toner on the intermediate transfer medium is applied, whereby the toner is second-transferred from the intermediate transfer belt to a recording medium. The intermediate transfer belt 409 passing between the back-up roll 408 and the second transfer roll 413 is cleaned by a cleaning blade 416 disposed near the drive roll 406 or a static eliminator (not shown), and is then repeatedly subjected to the next image forming process. Further, in a predetermined position in the housing 400, a tray (a transferred medium tray) 411 is provided. Transferred media 500 such as paper in the tray 411 are transported in order by a transport roll 412 between the intermediate transfer belt 409 and the second transfer roll 413, and further between two fixing rolls 414 adjacent to each other, and thereafter exhausted to the outside of the housing 400.

In a process cartridge in the exemplary embodiment, as shown in FIG. 10, the charge roll 402*a*, the electrophotographic photoreceptor 401*a*, the cleaning blade 415*a* and the development unit 404*a* are integrated, thereby to constitute, for example a process cartridge for black color. Similarly, the charge roll 402*b*, the electrophotographic photoreceptor 401*b*, the cleaning blade 415*b* and the development unit 404*b* are integrated, thereby to constitute a process cartridge for yellow color; the charge roll 402*c*, the electrophotographic photoreceptor 401*c*, the cleaning blade 415*c* and the development unit 404*c* are integrated, thereby to constitute a process cartridge for magenta color; and the charge roll 402*d*, the electrophotographic photoreceptor 401*d*, the cleaning blade 415*a* and the development unit 404*d* are integrated, thereby to constitute a process cartridge for cyan color.

The developer in the exemplary embodiment may be a two-component developer composed of toner and carrier.

The invention is applied to, for example, an image forming apparatus using an electrophotographic system, such as a copying machine or a printer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A development unit comprising:

a developer accommodating part that accommodates a developer therein;

a developer stirring-transporting member that transports the developer in the developer accommodating part while stirring the developer;

a bearing part that receives a rotating shaft of the developer stirring-transporting member;

a magnetic member that is located between the bearing part and the developer accommodating part and fixed around the rotating shaft, and a stirring member that is spaced apart from the magnetic member, that includes a projection portion being opposed to the magnetic member and that is arranged at the rotating shaft of the developer stirring-transporting member and is wider in circumference than the rotating shaft, the projection portion stirring the developer.

2. The development unit according to claim 1, wherein the stirring member is brush-shaped solid.

3. The development unit according to claim 1, wherein the stirring member is made of a material having a magnetism of an opposite polarity to that of the magnetic member.

4. A process cartridge comprising a development unit according to claim 1.

5. An image forming apparatus comprising:

an image carrier;

a development member that develops an electrostatic image formed on the image carrier with a developer as a toner image;

a transfer member that transfers the toner image formed on the image carrier onto a transferred body; and a fixing member that fixes the toner image transferred onto the transferred body, wherein the development member comprises a development unit according to claim 1.

6. A development unit comprising:

a developer accommodating part that accommodates a developer therein;

a developer stirring-transporting member that transports the developer in the developer accommodating part while stirring the developer;

a bearing part that receives a rotating shaft of the developer stirring-transporting member;

a magnetic member that is located between the bearing part and the developer accommodating part and fixed around the rotating shaft; and a stirring member that is wider in circumference than the rotating shaft and that includes a projection portion being opposed to the magnetic member and stirring the developer with rotation of the rotating shaft, the developer attracted to the magnetic member.

7. The development unit according to claim 6, wherein the stirring member is brush-shaped solid.

8. The development unit according to claim 6, wherein the stirring member is made of a material having a magnetism of an opposite polarity to that of the magnetic member.

9. A process cartridge comprising a development unit according to claim 6.

10. An image forming apparatus comprising:

an image carrier;

a development member that develops an electrostatic image formed on the image carrier with a developer as a toner image;

a transfer member that transfers the toner image formed on the image carrier onto a transferred body; and a fixing member that fixes the toner image transferred onto the transferred body, wherein the development member comprises a development unit according to claim 6.

* * * * *